United States Patent [19]

Brenna

[11] Patent Number: 5,064,329

[45] Date of Patent: Nov. 12, 1991

[54] LOADING ARRANGEMENT FOR LOADING FLUIDS ONTO A SHIP AT SEA

[75] Inventor: Bjørn J. Brenna, Kristiansand, Norway

[73] Assignee: MCG A.S., Arendal, Norway

[21] Appl. No.: 646,418

[22] Filed: Jan. 28, 1991

[30] Foreign Application Priority Data

Jan. 30, 1990 [NO] Norway ..... 900426

[51] Int. Cl.[5] ..... B63B 27/43

[52] U.S. Cl. ..... 414/137.7; 114/230; 441/5

[58] Field of Search ..... 414/137.7; 441/3-5; 114/230, 293; 137/236, 387, 388, 279; 52/727, 731

[56] References Cited

U.S. PATENT DOCUMENTS

| | | | |
|---|---|---|---|
| 3,921,684 | 11/1975 | Allen | 114/230 X |
| 3,922,992 | 12/1975 | Wilbourn | 114/230 |
| 4,020,779 | 5/1977 | Kitt | 114/230 X |
| 4,150,636 | 4/1979 | Lundh | 114/230 |
| 4,207,639 | 6/1980 | Nguyen Duc | 114/230 X |
| 4,281,611 | 8/1981 | Vilain | 114/230 |
| 4,493,282 | 1/1985 | Ortloff | 114/230 |
| 4,722,293 | 2/1988 | Foster et al. | 114/230 |
| 4,786,266 | 11/1988 | Fozard et al. | 114/230 X |
| 4,802,431 | 2/1989 | Pollack | 114/230 |

*Primary Examiner*—Robert J. Spar

*Assistant Examiner*—Brian K. Dinicola

*Attorney, Agent, or Firm*—Nixon & Vanderhye, P.C.

[57] ABSTRACT

A loading arrangement for loading fluids onto a ship at sea comprises a coupling manifold on board the ship. A pulling line, which is connected with a winch on board the ship and comprises a loading fork with two diverging parts which at a respective end are connected to a coupling head, may be guided on board and towards the winch, via a guide pulley which is mounted on board the ship to be movable in a controlled manner in the direction of pulling line towards and away from the winch. The coupling manifold is mounted to be slewable about a horizontal axis, so that it may be slewed towards and away from the loading fork. The coupling manifold has a guiding member in the shape of a curved screen, which in a vertical plane has a trapezoid shape and passes through a triangular area of the loading fork between the two parts. When the loading fork is brought into a position outside the coupling manifold by the aid of the winch, the coupling manifold may be slewed in a direction towards the loading fork so that the guiding member, i.e. curved screen, contacts the loading fork and fixes the latter in the fork plane. Cooperation between the screen and the fork is facilitated by the fact that the guide pulley is, as mentioned, displaceable in the direction of the pulling line, towards and away from the winch.

3 Claims, 8 Drawing Sheets

LOADING ARRANGEMENT FOR LOADING FLUIDS ONTO A SHIP AT SEA

SUMMARY OF THE INVENTION

The invention relates to a loading arrangement for loading fluids into a ship at sea, comprising:

a coupling manifold on board the ship, a loading hose with a coupling head to be connected with the coupling manifold, a pulling line connected with a winch on the vessel, and comprising a loading fork with two diverging parts, which are at a respective end connected with said coupling head on mutually opposed sides of the coupling head, a guide pulley on the vessel and above said coupling manifold for guiding the pulling line on board and towards the winch, a bearing for the couping manifold, permitting the manifold to be slewed about a horizontal axis towards and away from the loading fork a manipulatable hook means connected with the coupling manifold for gripping cooperation with the coupling head, and drive means for swinging the coupling manifold and for manipulating the hook means, so that the coupling head may be aligned relative to and lifted towards the coupling manifold and connected with it.

Alignment and lifting followed by coupling of said coupling head with the coupling manifold constitute a critical phase during connecting operations. For mooring and connection a variety of different methods may be used. It may even be possible to make do without a separate mooring line, utilizing dynamic positioning relative to a loading buoy. Irrespective of the method used, the final connection presents problems. The ship and the loading hose will carry out relative motions requiring very much care during the final phase of connection.

It is, thus, an object of the invention to provide a loading arrangement providing a possibility of controlled final manipulation of the coupling head of the loading hose in the completing phase of connection. According to the invention a loading arrangement as mentioned above is, thus, proposed, which loading arrangement is characterized by the fact that the guide pulley is mounted for controllable movement in the direction of the pulling line towards and from the winch, and by the fact that the coupling manifold comprises a guide means in the form of a curved screen with a trapezoid shape in vertical elevation, which is adapted to the triangular region of the loading fork between its two parts, and which may, when the manifold is swinging, get in contact with the loading fork and fix it in the fork plane.

In this manner the coupling manifold and coupling head may be brought closely together with an at least fairly satisfactory alignment. The coupling head will be fixed, via the fixed loading fork, and thus safe gripping of the coupling head by the hook means is rendered possible for final lifting up towards the coupling manifold for connection.

The hook means which is used during the final connection, may advantageously comprise working cylinders, which are mounted on the coupling manifold in a drivable manner to be slewable, and the piston rods of which are provided with free ends designed like loading hooks, the coupling head having corresponding pins for the hooks to grip.

BRIEF DESCRIPTION OF THE DRAWINGS

The invention will be disclosed in more detail below with reference to the drawing, in which.

DESCRIPTION OF THE PREFERRED EMBODIMENT

Figure 1:
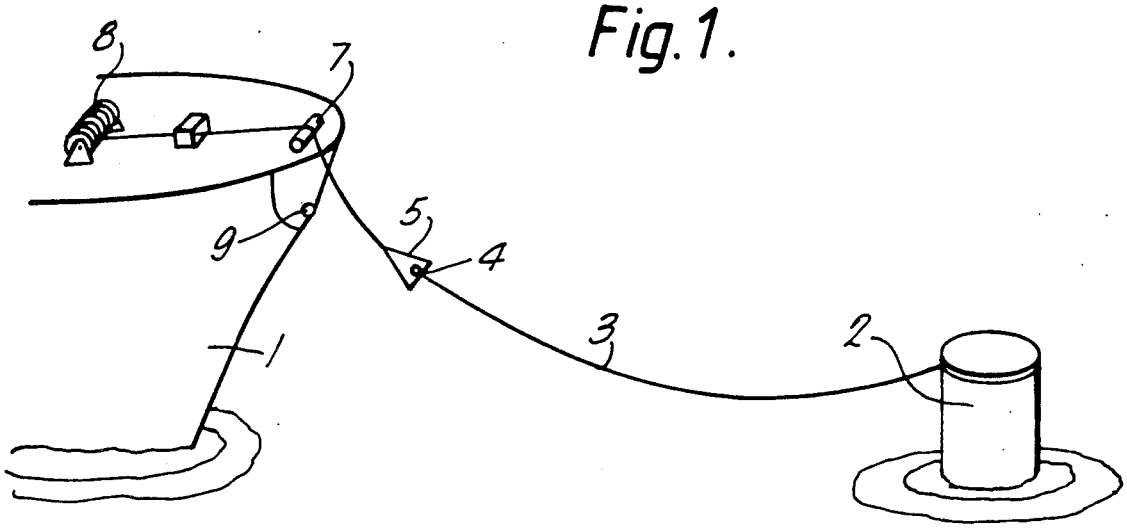
FIG. 1 shows a method by the aid of which a loading hose may be brought on board a ship and connected with a coupling manifold.

In FIG. 1 the bow area of a ship 1 is shown. Furthermore, a so called loading buoy 2 is shown. A loading hose 3 extends from the loading buoy. The loading hose has a coupling head 4. A loading line fork 5 is connected with coupling head 4 of the loading hose and is suspended from a pulling line 6 which passes, via a guide pulley 7, to a winch 8 on board ship 1.

In the ship's bow a coupling manifold 9 is indicated, with which coupling head 4 is to be connected to provide a loading connection between loading buoy 2 and ship 1. From coupling manifold 9 piping extends in a manner not shown to the loading tanks of the ship.

By the aid of pulling line 6, which is hauled in by the aid of winch 8, coupling head 4 and loading hose 3 will, obviously, be pulled up towards coupling manifold 9, where connection is made in a manner disclosed in more detail below.

Figure 2:
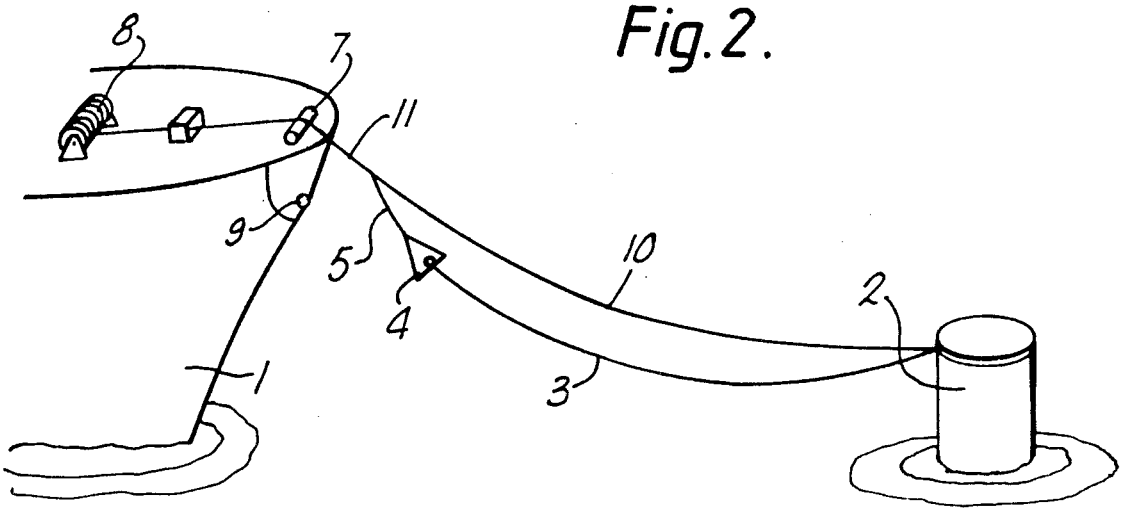
FIG. 2 shows another method for bringing a loading hose on board a ship, by use of a mooring line.

FIG. 2 shows another method for connecting the loading hose. Here, the same ship 1, loading buoy 2, and loading hose 3 with head 4 and loading fork 5 are shown. As opposed to FIG. 1 loading fork 5 is suspended from a pulling line 11, which forms part of the mooring line 10 of ship 1. In the same manner as pulling line 6 in FIG. 1, pulling line 11 extends to a winch 8 on board ship 1, via guide pulley 7 in the bow, above coupling manifold 9, which is also provided here. By the aid of winch 8 pulling line/mooring line 9, 10 are hauled in. The loading fork 5 with coupling head 4 and loading hose 3 are brought along, above and towards coupling manifold 9, where connection occurs in a manner disclosed in more detail below, which is, besides, the same manner as in the arrangement shown in FIG. 1.

Figure 3:
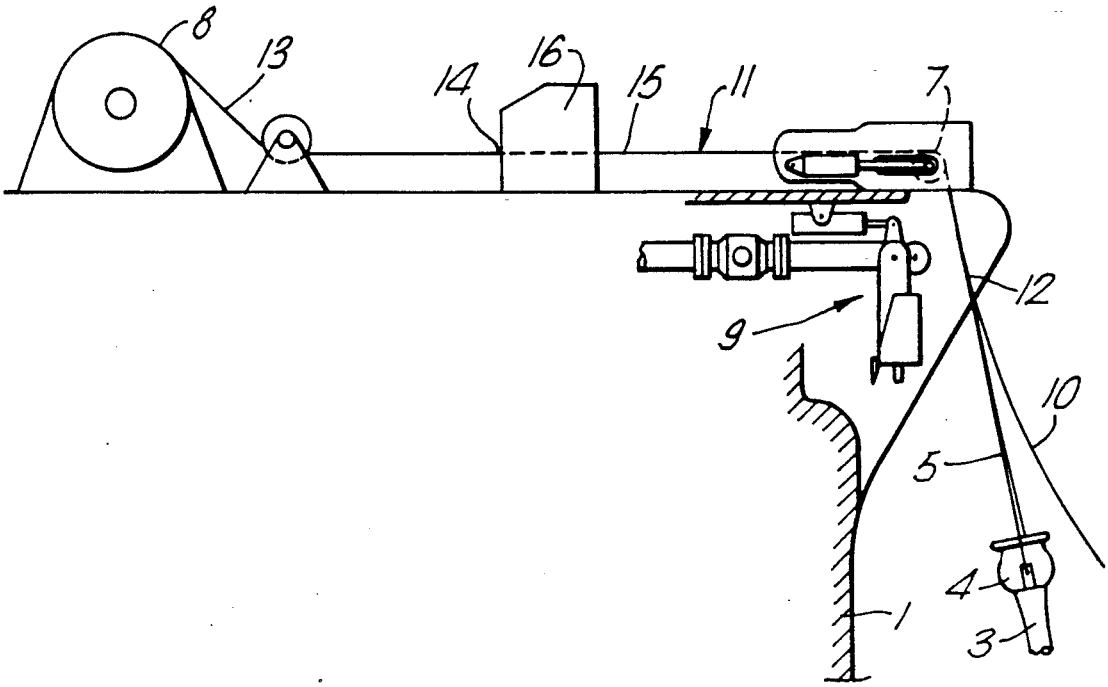
FIG. 3 is a partial view of the bow area on board a ship with an arrangement according to the invention, during hauling in a mooring line with a loading hose suspended from it.
Figure 4:
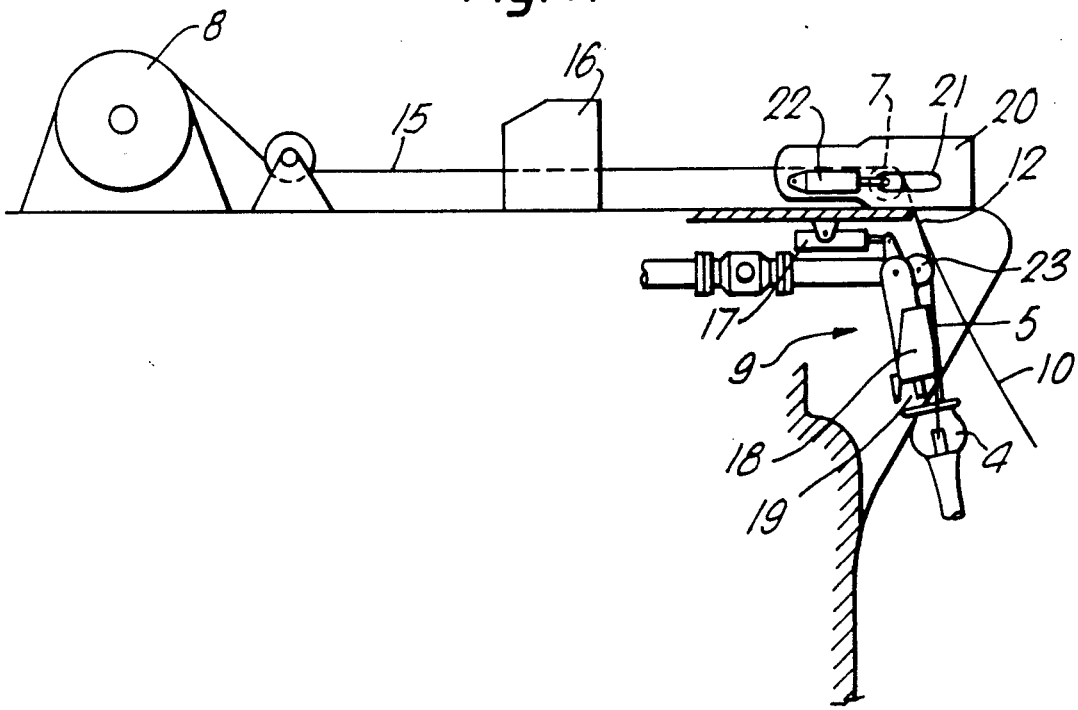
FIG. 4 shows the arrangement of FIG. 3 in the final phase, when the coupling head is to be connected with the coupling manifold on board the ship.
Figure 5:
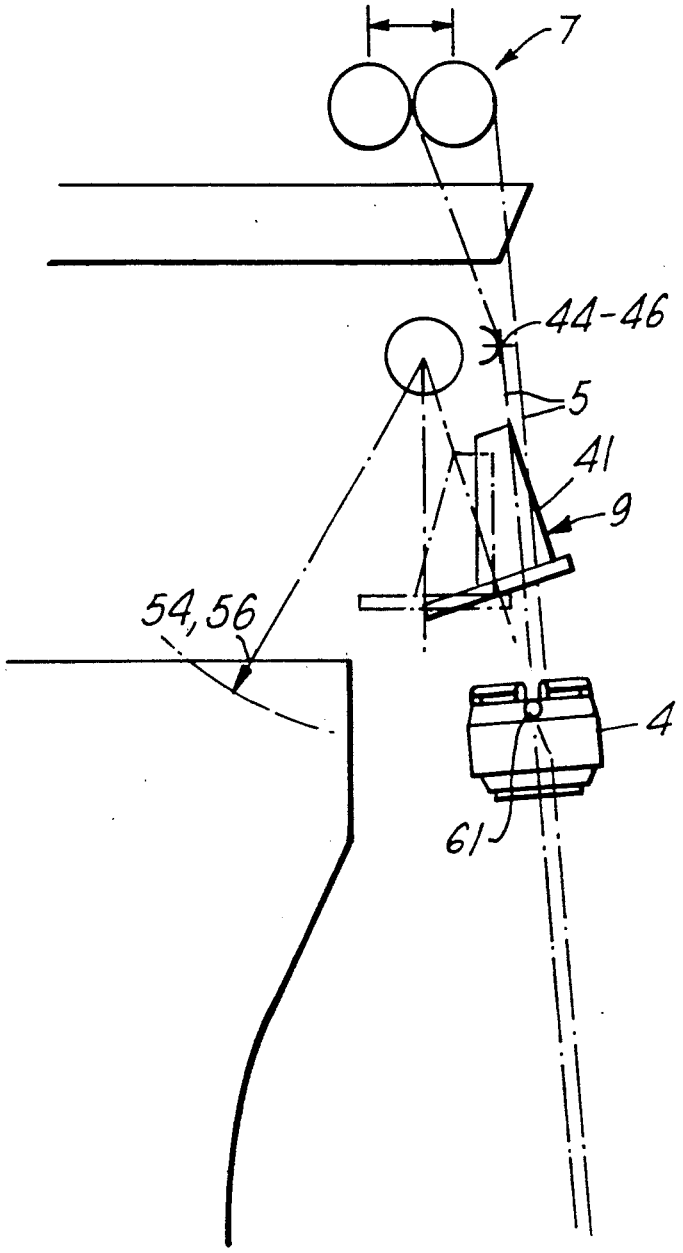
FIG. 5 is a sketch showing how the arrangement of FIGS. 3 and 4 operates.

In FIGS. 3, 4, and 5 of the drawings it is assumed that the method indicated in FIG. 2 is used. From FIGS. 3–5 ship 1, loading hose 3, its coupling head 4, loading fork 5, winch 8, guide pulley 7, pulling line 11, mooring line 10 proper, and coupling manifold 9 will, thus, appear.

Loading fork 5 consists of two steel ropes which meet approximately at 12, where the loading fork is suspended from pulling line 11. In a preferred practical embodiment the arrangement comprises a mooring line comprising a so called fore runner, a chain portion, and then the mooring line proper. In FIGS. 3 and 4 the fore runner is indicated by numeral 13. Approximately at 14, said fore runner 13 is connected with a length of chain 15, which is in the area of numeral 12 connected with mooring line 10 proper. It will appear that mooring line 10 is hauled on board by the aid of winch 8, which acts on fore runner 13 until chain portion 15 has achieved the position as shown in FIG. 4. The chain portion may now be locked in a chain stopper 16. Ship 1 will then be moored to the loading buoy.

When mooring line 10 and loading fork 5 with suspended coupling head 4 and associated loading hose 3 are located in the position as shown in FIG. 4, coupling manifold 9 is moved forwards, into contact with loading fork 5. This slewing motion of coupling manifold occurs by the aid of the indicated working cylinder 17. As indicated in FIG. 4, a curved screen 18 on coupling manifold 9 will provide guiding cooperation with loading fork 5 causing the latter to be fixed in the fork plane. Coupling head 4 will, thus, be correspondingly fixed and will be fairly aligned relative to the coupling member 19 of coupling manifold 9.

Figure 7:
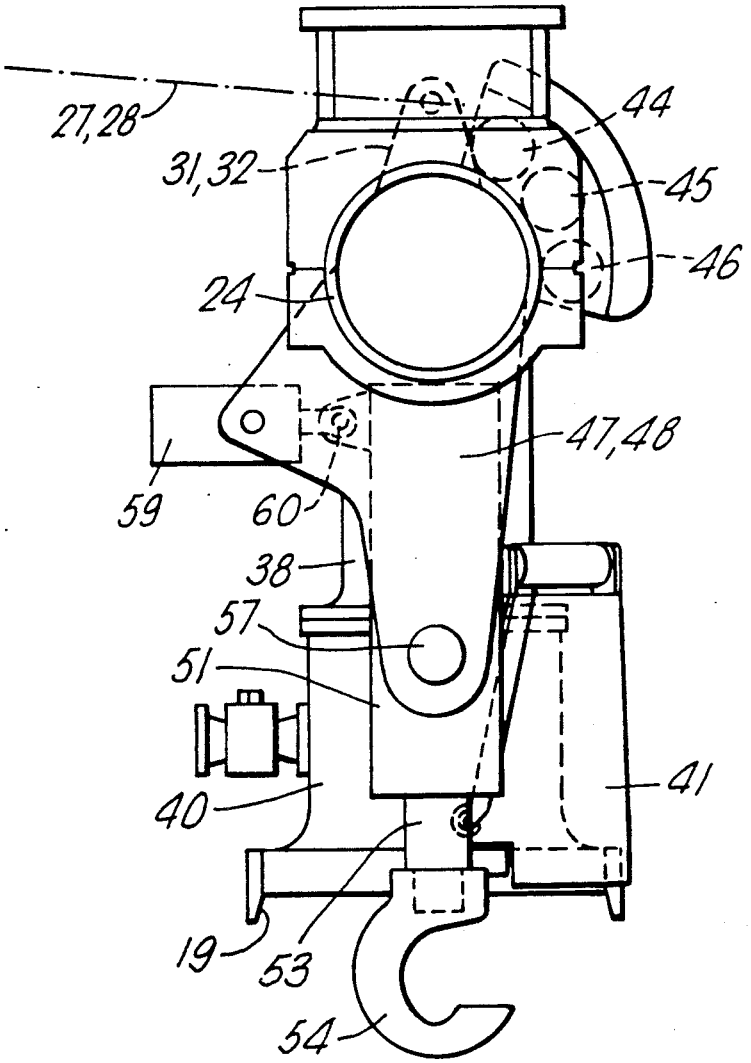
FIG. 7 is an elevational view of the coupling manifold of FIG. 6.

Slewing the coupling manifold 9 towards loading fork 5, into the position shown in FIG. 4, occurs at the same time as or just after guide pulley 7 is displaced rearwards from the position as shown in FIG. 7, and into a position as shown in FIG. 4. For such displacement of the guide pulley to be rendered possible, it is rotatably and displaceably mounted in a guide pulley bracket 20, which is provided with elongated grooves 21, in which the shaft of guide pulley 7 is mounted. By the aid of a working cylinder 22, guide pulley 7 may, thus, be displaced back and forth between the extreme positions which are shown in FIG. 3 and FIG. 4, respectively. When guide pulley 7 is pulled in an aft direction, as shown in FIG. 4, pulling line, mooring line, and loading fork will be moved aft, i.e. in towards coupling manifold 9 and into contact with the latter, as shown in FIG. 4.

Coupling manifold 9 has a guide pulley means 23 to guide guiding line/loading fork towards guide pulley.

The sequence of motion during coupling operations is shown in more detail in FIG. 5.

Figure 6:
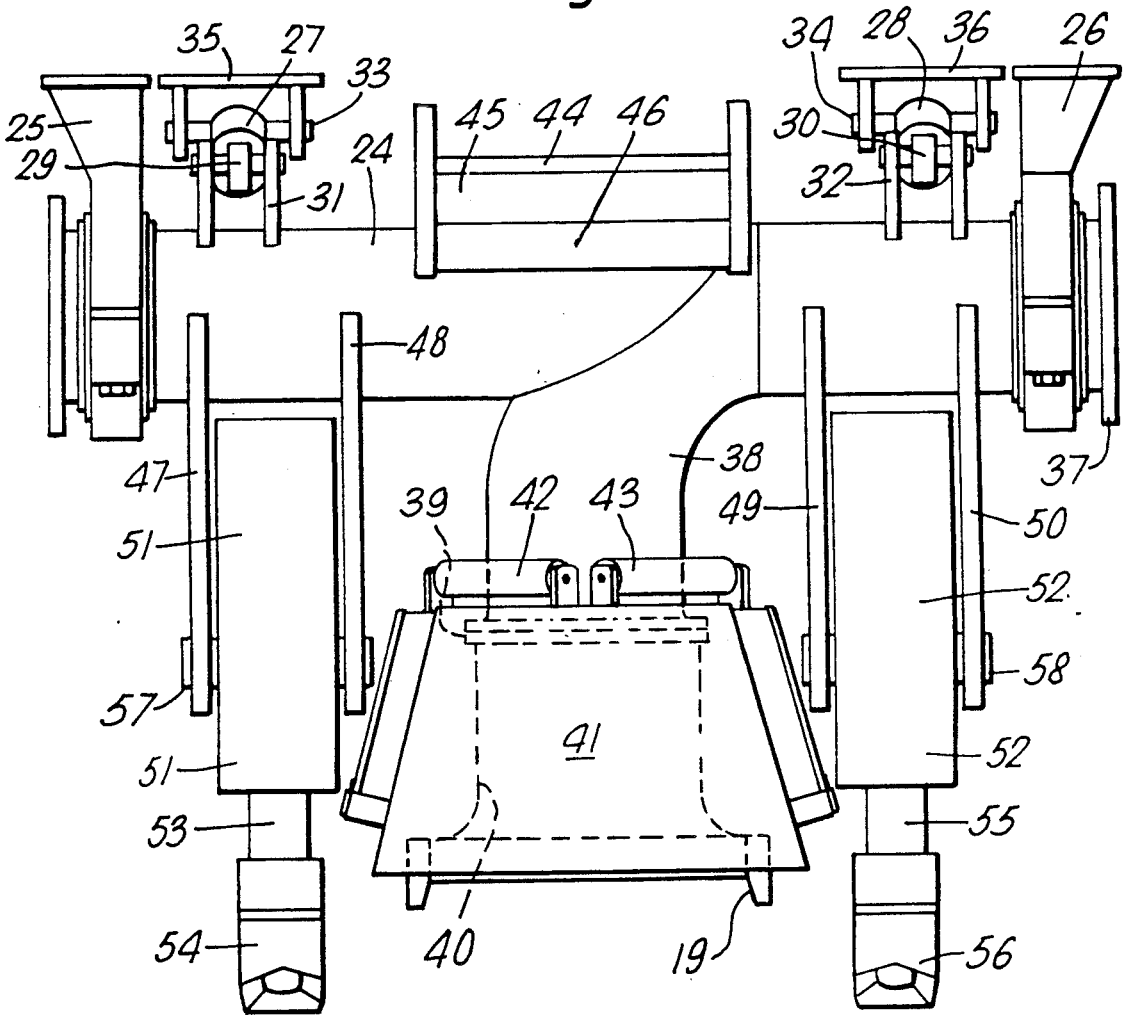
FIG. 6 is a plan view of a coupling manifold constituting part of the arrangement according to the invention.

FIGS. 6 and 7 show a practical and preferred embodiment of a coupling manifold forming part of the new arrangement according to the invention.

The manifold is built with a sturdy transversal pipe 24, which is at both ends slewably mounted in brackets 25, 26, which are designed to be mounted below deck forward in the bow opening. Pipe 24 may be slewed by the aid of two working cylinders 27, 28, the piston rods 29, 30 of which are link coupled to brackets 31, 32, which are welded onto pipe 24. Each of the working cylinders 27, 28 is slewably mounted 33, 34 in brackets 35, 36, which are intended to be fastened below deck, in the same manner as working cylinder 17, which is shown in FIGS. 3 and 4, and which is in the present case replaced by two working cylinders.

Pipe 24 is provided with a coupling flange 37 for connection with a conduit extending further into the ship. The other tube end, at bracket 25, is closed, but may obviously, if desired, be provided with a flange corresponding to flange 37, for connection with piping on board the ship.

In the lateral elevation of FIG. 7 working cylinders 27, 28 are indicated by point-dash-line 27, 28.

Figure 8:
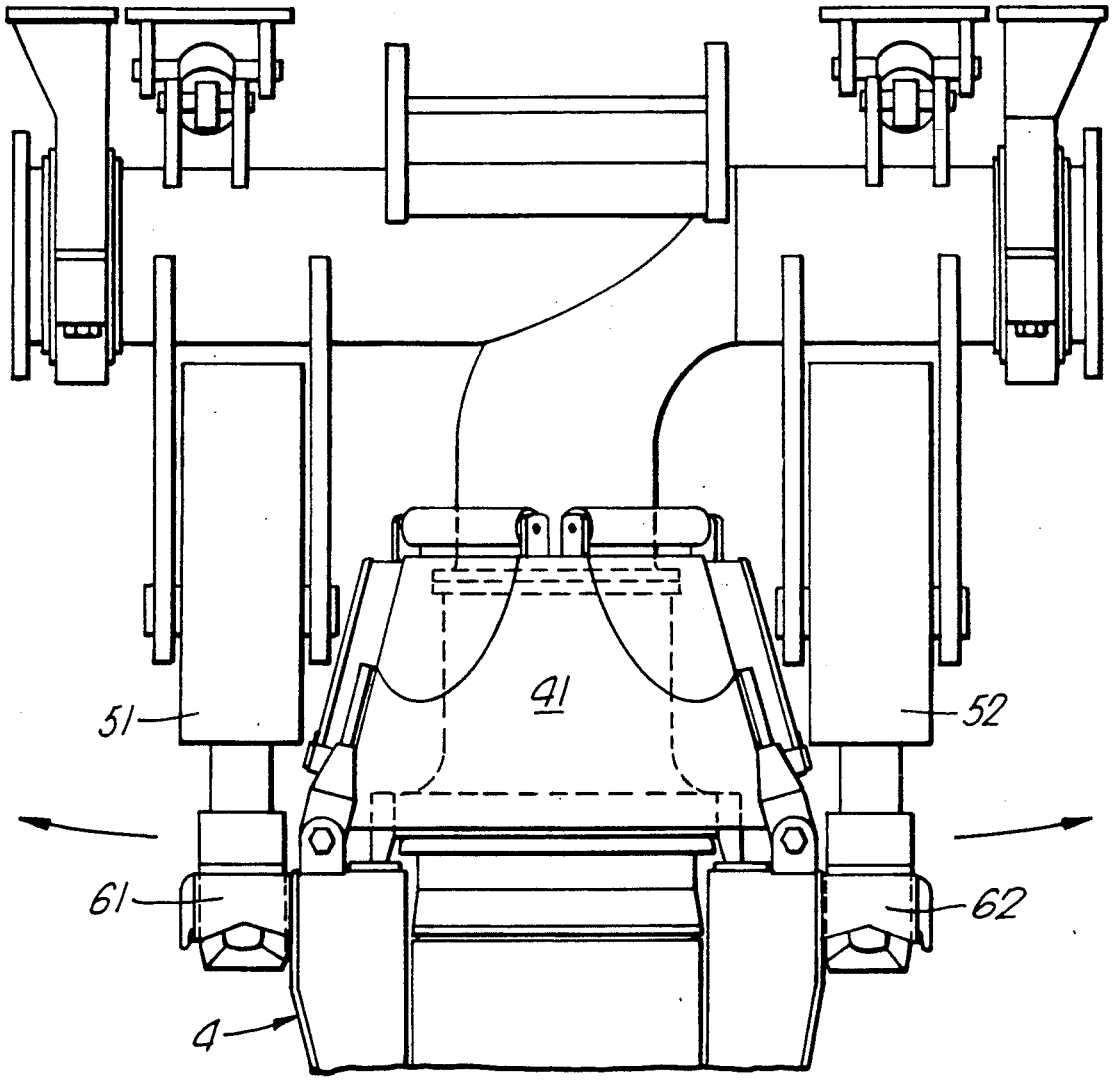
FIG. 8 is a plan view of the coupling manifold of FIGS. 6 and 7, but with a coupling head which is positioned to be connected.
Figure 9:
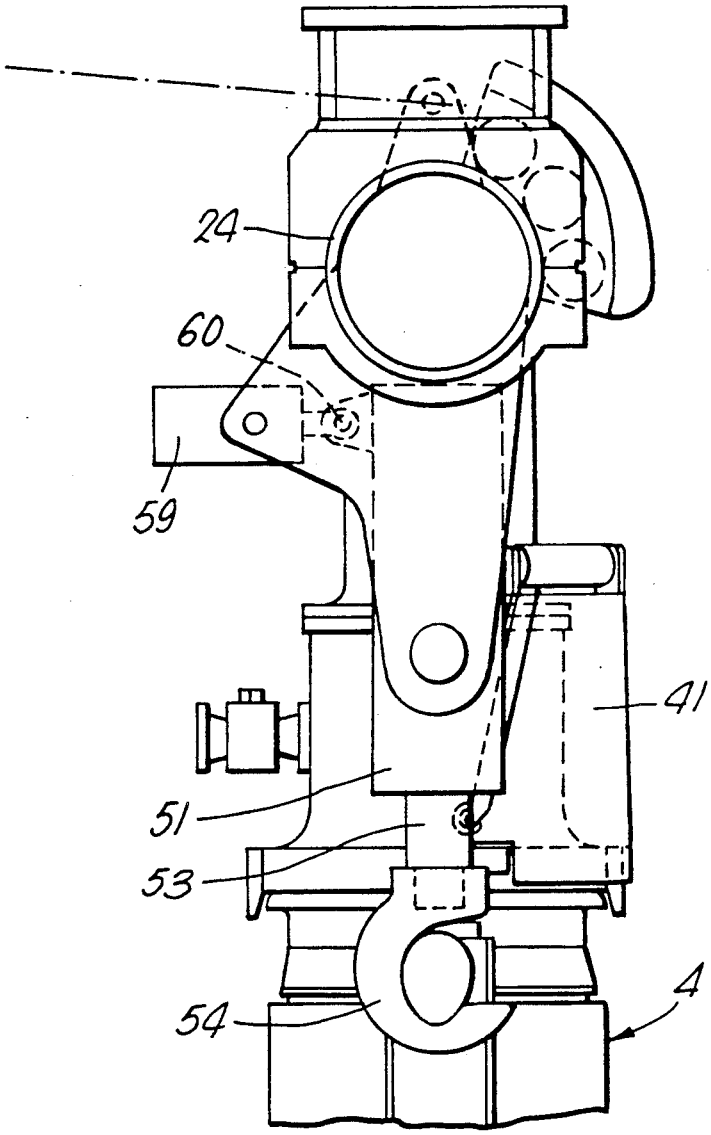
FIG. 9 is an elevational view of the arrangement of FIG. 8.

From pipe 24 a pipe bend 38 branches off. Pipe bend 28 is flange coupled 39 to a coupling box 40 the lower end of which is designed to receive coupling head 4, as shown in FIG. 4 and FIGS. 8 and 9. In accordance with FIG. 4, the lower portion of coupling box 40 is, thus, denoted 19.

On coupling box 40 a guide member in the shape of a curved screen 41, corresponding to screen 18 in FIGS. 3 and 4, is mounted.

On top of the screen, which is trapezoid in the vertical elevation of FIG. 6, two guide rollers 42, 43 are placed. On pipe 24 above said guide rollers 43, 44 three parallel guide rollers 44, 45, 46 are provided.

Four bracket plates 47, 48, 49, and 50 are welded onto pipe 24. In pairs they carry a working cylinder 51, 52, respectively. Piston rod 53 of working cylinder 51 is at its free end finished with a hook 54, and piston rod 55 of working cylinder 52 is, correspondingly, finished with a hook 56. As shown, working cylinders are at 57, and at 58, respectively, rotatably mounted in bracket plate pairs 47, 48, and 49, 50, respectively. As shown in FIG. 7, working cylinder 51 may be slewed about slewing pivot 57 by the aid of a working cylinder 59, which is rotatably mounted in bracket plates 47, 48 and the piston rod of which is at 60 pivoted in working cylinder 51. A corresponding arrangement is provided for working cylinder 52.

It should be mentioned here that manifold 9, which is shown in FIGS. 3 and 4, and which may be designed like the manifold of FIGS. 6 and 7, is also provided with a hook arrangement corresponding to hooks 54, 56, but the hook arrangement was left out in FIGS. 3 and 4 so as not to overburden those rather small figures with too many details.

In FIGS. 8 and 9 the coupling manifold of FIGS. 6 and 7 is shown together with coupling head 4 on the loading hose. Coupling head 4 is placed in a position as shown in FIG. 4, in which position hooks 54, 56 are able to grip the lifting head and lift it closer up to coupling surface 19 of coupling box 40, so that a connection between coupling head and coupling box may be completed. Connecting operations proper comprise technology known per se and are, thus, not described in detail. As soon as the connection is completed, loading operations may start upon enabling the necessary valves.

The entire connecting sequence is disclosed below. The mooring situation is shown in FIG. 2. Ship 1 will establish connection with loading buoy 2 by receiving the mooring line on board. The mooring line comprises a fore runner 13, a chain portion 15, and the mooring line 10 proper. Line 13 is pulled on board by the aid of winch 8, until chain portion 15 is provided in a desired position in chain stopper 16. Chain portion 15 is locked in chain stopper 16. Ship 1 is now moored to loading buoy 2. This is the situation as illustrated in FIG. 3. Guide pulley 7 is in its forward position in the ship's bow. Loading hose 3 is attached to chain 15 by the aid of a rope fork 5. In FIG. 3 coupling head 4 of the loading hose is shown in a slightly lower position than the real one, when mooring takes place. In reality coupling head 4 will be in a slightly higher position than the position illustrated in FIG. 4. The reason for showing a different position in FIG. 3 is just to illustrate how coupling head 4 is suspended from loading fork 5 during the final phase of connecting operations. The correct position is shown in FIG. 5. Here, coupling head 4 is shown to be pulled up towards coupling manifold 9, while the latter is still in its retracted position, as indicated in dashed lines. Guide pulley 7 is in its forward position. Hooks 54, 56 are represented by arrow 54, 56, and are run down as far as possible to be able to grip beneath lifting pins 61, 62 on coupling head 4 when being slewed forwards.

Guide pulley 7 is retracted to its left hand side position in FIG. 5. Coupling head 4 is, thus, given a slightly lower position and is at the same time moved slightly aft, i.e. in the direction of coupling manifold 9. Coupling manifold 9 is slewed towards the right hand side in FIG. 5, into the position shown in full lines, with screen 41 exerting a guiding influence on the triangle formed by loading fork 5. During the swinging movement of coupling manifold 9 towards the right hand side in FIG. 5, hooks 54, 56 will follow since they are suspended from coupling manifold. By the aid of working cylinders 59, and by the aid of cylinders 51, 52, which are associated with the hooks, hooks 54, 56 may be finely adjusted relative to lifting pins 61, 62 and catch the latter, as shown in FIGS. 8 and 9. By the aid of hooks 54, 56 coupling head 4 may then be pulled up towards coupling surface 19 of the coupling manifold and be connected with the coupling half of the coupling manifold.

Hooks 61 and 62, i.e. their associated cylinders 57, may in stead be mounted to carry out swinging motion in a transversal direction, as indicated by arrows in FIG. 8, the working cylinders 59 then being turned 90°.

It will be understood that the function of guide pulley 7 is important because the loading fork 5 may be guided towards coupling manifold 9 by the aid of said pulley.

Figure 10:
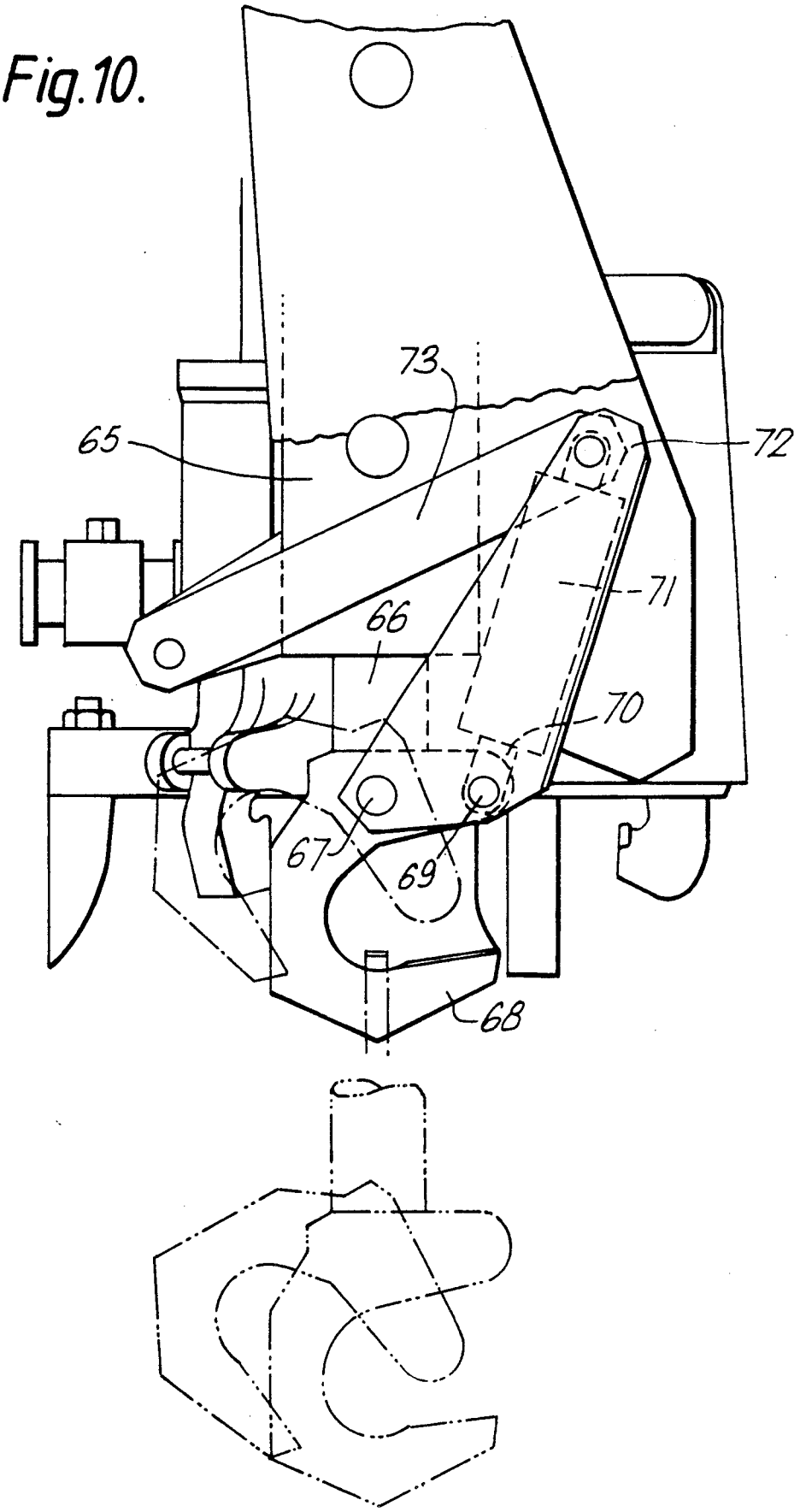
FIG. 10 shows another possible hook arrangement.

FIG. 10 shows an example of a hook arrangement, the loading hooks 68 of which are pivotally mounted on a respective piston rod 66 associated with a working cylinder 65. Loading hook 68 is linked 69 with piston rod 70 of a manipulator cylinder 71, which is mounted on working cylinder 65 by the aid of the shown arms 72, 73. By the aid of manipulator 70, 71 hooks may be slewed into an "open" position, as shown in dashed lines.

Having described my invention, I claim:

1. A loading arrangement for loading fluids onto a ship at sea, comprising:

a coupling manifold on board said ship, a loading hose with a coupling head for connection with said coupling manifold, a pulling line connected at one end to a winch on board said ship, and comprising a loading fork with two diverging parts which are at their respective ends connected with said coupling head on mutually opposed sides of said coupling head, a guide pulley on board said ship and above said coupling manifold for guiding said pulling line on board said ship and towards said winch, a bearing means for said coupling manifold to slew said coupling means towards and away from said loading fork about a horizontal axis, a manipulatable hook means included on said coupling manifold for gripping cooperation with said coupling head, and driving means for swinging said coupling manifold and said manipulatable hook means so that said coupling head may be aligned with and lifted towards said coupling manifold and connected with the latter, whereby said guide pulley is mounted for controllable motion in the direction of said pulling line in a direction towards and from said winch, and said coupling manifold comprises a guide means in the form of a curved screen, which in a vertical plane has a trapezoid shape and passes through a triangular area of said loading fork formed by said two diverging parts, and which may contact the loading fork and fix the loading fork in a fork plane formed by said triangular area when said manifold is slewed.

2. A loading arrangement according to claim 1, characterized in that said manipulatable hook means comprises working cylinders, which are mounted on said coupling manifold to be slewable in a drivable manner, and said working cylinders being provided with piston rods having free ends in the form of loading hooks, said coupling head having corresponding pins for said free end loading hooks to grip.

3. A loading arrangement according to claim 1, characterized in that said manipulatable hook means comprises working cylinders, which are mounted on the coupling manifold, each working cylinder having a piston rod which carries a pivoted loading hook, and each loading hook being linked to a respective piston rod of a manipulator cylinder.

* * * * *